US007640679B2

(12) United States Patent
Sokolowski et al.

(10) Patent No.: US 7,640,679 B2
(45) **Date of Patent: *Jan. 5, 2010**

(54) MIDSOLE ELEMENT FOR AN ARTICLE OF FOOTWEAR

(75) Inventors: Susan L. Sokolowski, Portland, OR (US); Susanne Amalie Wolf-Hochdoerffer, Portland, OR (US); Lorrie Vogel, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 31 days.

This patent is subject to a terminal disclaimer.

(21) Appl. No.: 11/962,341

(22) Filed: Dec. 21, 2007

(65) Prior Publication Data

US 2008/0092404 A1 Apr. 24, 2008

Related U.S. Application Data

(62) Division of application No. 10/924,257, filed on Aug. 24, 2004, now Pat. No. 7,334,349.

(51) Int. Cl.
*A43B 13/14* (2006.01)

(52) U.S. Cl. ..... 36/25 R; 36/28; 36/32 R

(58) Field of Classification Search ..... 36/25 R, 36/28, 32 R, 30 R, 31, 37, 35 R, 142–144
See application file for complete search history.

(56) References Cited

U.S. PATENT DOCUMENTS

| | | | |
|---|---|---|---|
| 1,231,777 | A | 7/1917 | Mussinan |
| 2,884,716 | A | 5/1959 | Shelare et al. |
| 2,985,971 | A | 5/1961 | Murawski |
| 4,235,026 | A | 11/1980 | Plagehoef |
| 4,262,433 | A | 4/1981 | Hagg et al. |
| 4,297,796 | A | 11/1981 | Stirtz et al. |
| 4,361,972 | A | 12/1982 | Miller |
| 4,445,284 | A | 5/1984 | Sakutori |
| 4,536,974 | A | 8/1985 | Cohen |
| 4,611,412 | A | 9/1986 | Cohen |
| 4,638,577 | A | 1/1987 | Riggs |
| 4,753,021 | A | 6/1988 | Cohen |
| 4,754,559 | A | 7/1988 | Cohen |
| 4,774,774 | A | 10/1988 | Allen, Jr. |

(Continued)

FOREIGN PATENT DOCUMENTS

| | | |
|---|---|---|
| EP | 1358811 | 11/2003 |
| WO | 03-079840 | 10/2003 |

OTHER PUBLICATIONS

International Search Report in corresponding PCT Application No. PCT/US/2006/030219, mailed Dec. 23, 2005.

*Primary Examiner*—Marie Patterson
(74) *Attorney, Agent, or Firm*—Banner & Witcoff, Ltd.

(57) ABSTRACT

An article of footwear is disclosed that includes an upper and a sole structure secured to the upper. The sole structure has a midsole element that defines a void, and the void may extend substantially vertically through a central area of the midsole element. The void may also extend between an upper surface and a lower surface of the midsole element to define an interior surface. A plurality of bores are also defined in the midsole element. The bores may extend substantially horizontally through the midsole element, and the bores may extend between an exterior surface of the midsole element and the void.

15 Claims, 18 Drawing Sheets

U.S. PATENT DOCUMENTS

| | | | |
|---|---|---|---|
| 4,782,603 | A | 11/1988 | Brown |
| 4,817,304 | A | 4/1989 | Parker et al. |
| 4,881,329 | A | 11/1989 | Crowley |
| 5,005,300 | A | 4/1991 | Diaz et al. |
| 5,461,800 | A | 10/1995 | Luthi et al. |
| 5,577,334 | A | 11/1996 | Park |
| D376,471 | S | 12/1996 | Kalin et al. |
| D378,012 | S | 2/1997 | Le |
| 5,625,963 | A | 5/1997 | Miller et al. |
| 5,628,128 | A | 5/1997 | Miller et al. |
| 5,713,140 | A | 2/1998 | Baggenstoss |
| 5,761,831 | A | 6/1998 | Cho |
| 5,797,199 | A | 8/1998 | Miller et al. |
| 5,822,886 | A | 10/1998 | Luthi et al. |
| 5,983,529 | A | 11/1999 | Serna |
| 6,026,593 | A | 2/2000 | Harmon-Weiss et al. |
| 6,195,915 | B1 | 3/2001 | Russell |
| 6,487,796 | B1 | 12/2002 | Avar et al. |
| 6,647,645 | B2 | 11/2003 | Kita |
| 6,898,870 | B1 | 5/2005 | Rohde |
| 7,334,349 | B2 * | 2/2008 | Sokolowski et al. ..... 36/25 R |
| 2001/0010129 | A1 | 8/2001 | Russell |
| 2002/0129516 | A1 | 9/2002 | Lucas et al. |
| 2003/0061731 | A1 | 4/2003 | Turner et al. |
| 2003/0208929 | A1 | 11/2003 | Lucas et al. |
| 2004/0049946 | A1 | 3/2004 | Lucas et al. |
| 2005/0132607 | A1 | 6/2005 | Dojan et al. |
| 2005/0198863 | A1 | 9/2005 | Hockerson |

* cited by examiner

MIDSOLE ELEMENT FOR AN ARTICLE OF FOOTWEAR

CROSS-REFERENCE TO RELATED APPLICATIONS

This application is a divisional of U.S. patent Ser. No. 10/924,257, entitled "MIDSOLE ELEMENT FOR AN ARTICLE OF FOOTWEAR," filed Aug. 24, 2004, now U.S. Pat. No. 7,334,349 which is incorporated herein by reference herein in its entirety.

BACKGROUND OF THE INVENTION

1. Field of the Invention

The present invention relates to footwear. The invention concerns, more particularly, an article of footwear having a midsole element that defines a void and bores extending through the midsole element to the void.

2. Description of Background Art

A conventional article of athletic footwear includes two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground. In addition to attenuating ground reaction forces (i.e., imparting cushioning), the sole structure may provide traction and control foot motions, such as pronation. Accordingly, the upper and the sole structure operate cooperatively to provide a comfortable structure that is suited for a variety of ambulatory activities, such as walking and running.

The sole structure of athletic footwear generally exhibits a layered configuration that includes a comfort-enhancing insole, a resilient midsole formed from a polymer foam material, and a ground-contacting outsole that provides both abrasion-resistance and traction. In some articles of footwear, the midsole is the primary sole structure element that imparts cushioning and controls foot motions. Suitable polymer foam materials for the midsole include ethylvinylacetate or polyurethane that compress resiliently under an applied load to attenuate ground reaction forces. Conventional polymer foam materials are resiliently compressible, in part, due to the inclusion of a plurality of open or closed cells that define an inner volume substantially displaced by gas. The polymer foam materials of the midsole may also absorb energy when compressed during ambulatory activities.

The midsole may be formed from a unitary element of polymer foam that extends throughout the length and width of the footwear. With the exception of a thickness differential between the heel and forefoot areas of the footwear, such a midsole exhibits substantially uniform properties in each area of the sole structure. In order to vary the properties of midsole, some conventional midsoles incorporate dual-density polymer foams. More particularly, a lateral side of the midsole may be formed from a first foam material, and the medial side of the midsole may be formed from a second, less-compressible foam material. Another manner of varying the properties of the midsole involves the use of stability devices that resist pronation. Examples of stability devices include U.S. Pat. Nos. 4,255,877 to Bowerman; 4,288,929 to Norton et al.; 4,354,318 to Frederick et al.; 4,364,188 to Turner et al.; 4,364,189 to Bates; and 5,247,742 to Kilgore et al.

Another manner of varying the properties of the midsole involves the use of fluid-filled bladders. U.S. Pat. No. 4,183,156 to Rudy, discloses an inflatable insert formed of elastomeric materials. The insert includes a plurality of tubular chambers that extend substantially longitudinally throughout the length of the footwear. The chambers are in fluid communication with each other and jointly extend across the width of the footwear. U.S. Pat. No. 4,219,945 to Rudy discloses an inflated insert encapsulated in a polymer foam material. The combination of the insert and the encapsulating polymer foam material functions as the midsole. Examples of additional fluid-filled bladders for footwear include U.S. Pat. Nos. 4,906,502 and 5,083,361, both to Rudy, and U.S. Pat. Nos. 5,993,585 and 6,119,371, both to Goodwin et al.

SUMMARY OF THE INVENTION

The present invention is an article of footwear having an upper and a sole structure secured to the upper. The sole structure includes a midsole element that may be formed of unitary construction from a polymer foam material. A void is defined in the midsole element, and the void extends substantially vertically through a central area of the polymer foam material. The void also extends between an upper surface and a lower surface of the midsole element to define an interior surface. A plurality of bores are also defined in the midsole element. The bores extend substantially horizontally through the polymer foam material, and the bores extend between an exterior surface of the midsole element and the void.

In some embodiments of the invention, one or more of the bores have a substantially constant width dimension. Two or more of the bores may also have the same width dimension. In some embodiments, the bores may be formed such that unequal numbers of the bores are formed in a lateral side and a medial side of the midsole element. For example, the lateral side may form three bores, whereas the medial side forms two bores. Alternately, the lateral side may form two bores, whereas the medial side forms three bores.

The bores may form columns in the midsole element. In some embodiments, unequal numbers of the columns are formed in the lateral side and the medial side. One or more of the columns may also form a substantially vertical cavity, and some of the columns may not form a cavity. In addition, a column may form two or more cavities.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Introduction

The following discussion and accompanying figures disclose various articles of footwear having a sole element in accordance with the present invention. Concepts related to sole element are disclosed with reference to footwear having configurations that are suitable for various athletic activities, including running, training, and walking, for example. The invention is not solely limited to articles of footwear designed for running, training, and walking, however, and may be applied to a wide range of athletic footwear styles that include basketball shoes, hiking shoes, tennis shoes, volleyball shoes, soccer shoes, and football shoes, for example. In addition to athletic footwear, concepts related to the invention may be applied to footwear that is generally considered to be non-athletic (e.g., dress shoes, sandals, and work boots) or footwear serving a medical or rehabilitative purpose. Accordingly, one skilled in the relevant art will appreciate that the concepts disclosed herein apply to a wide variety of footwear styles, in addition to the specific footwear styles discussed in the following material and depicted in the accompanying figures.

FIRST EMBODIMENT

Figure 1:
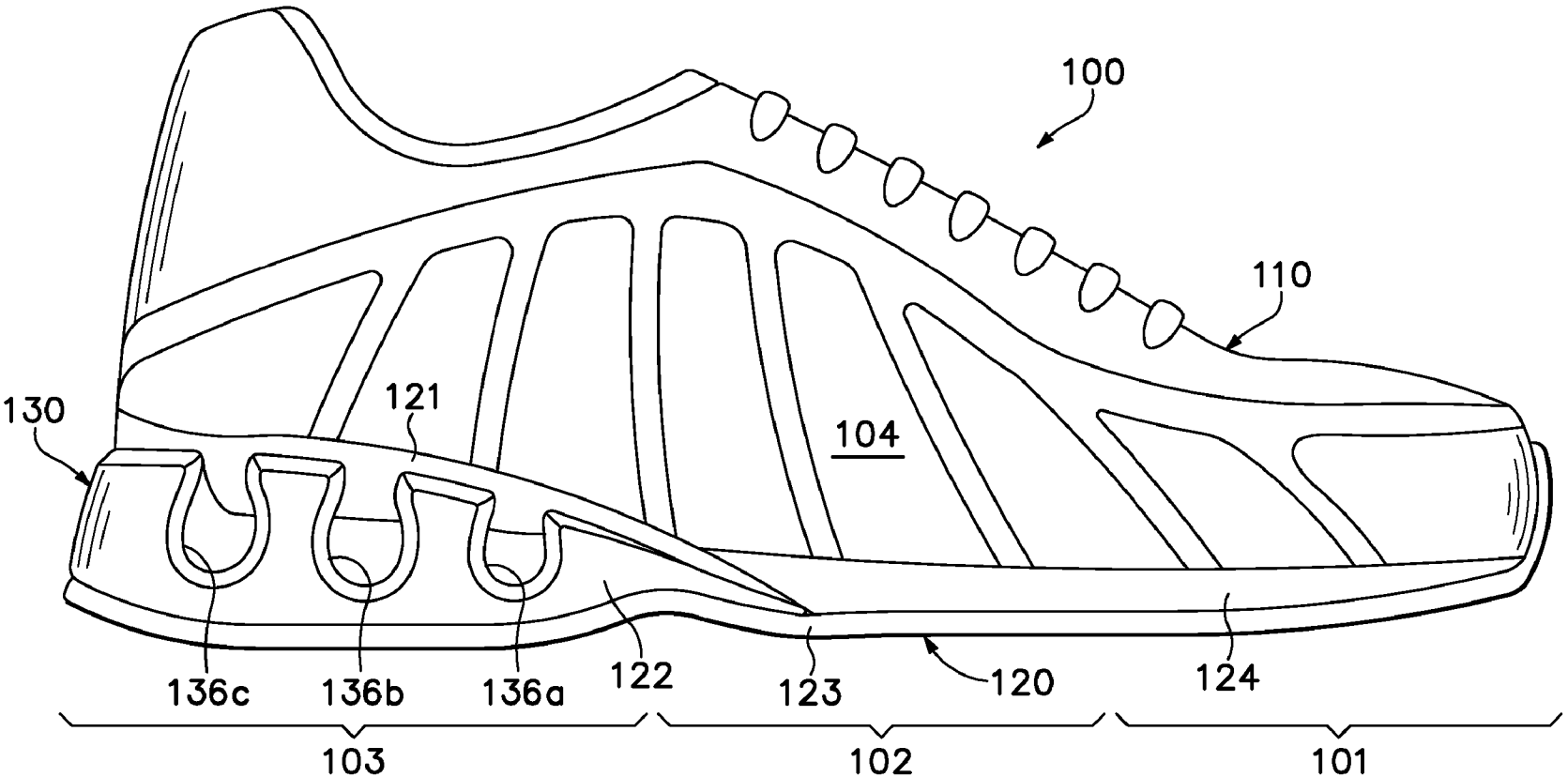
FIG. 1 is a lateral side elevational view of an article of footwear having a first midsole element in accordance with the present invention.

Article of footwear 100, as depicted in FIG. 1, includes an upper 110 and a sole structure 120 that are suitable for a variety of athletic activities, including running, for example. Upper 110 has a generally conventional configuration incorporating a plurality material elements (e.g., textiles, foam, and leather) that are stitched or adhesively bonded together to form an interior void for securely and comfortably receiving a foot. The material elements may be selected and located with respect to upper 110 in order to selectively impart properties of durability, air-permeability, wear-resistance, flexibility, and comfort, for example. In addition, upper 110 may include a lace that is utilized in a conventional manner to modify the dimensions of the interior void, thereby securing the foot within the interior void and facilitating entry and removal of the foot from the interior void. The lace may extend through apertures in upper 110, and a tongue portion of upper 110 may extend between the interior void and the lace. Accordingly, upper 110 may exhibit a substantially conventional configuration within the scope of the present invention.

For reference purposes in the following material, footwear 100 may be divided into three general regions: a forefoot region 101, a midfoot region 102, and a heel region 103, as depicted in FIG. 1. Forefoot region 101 generally includes portions of footwear 100 corresponding with the toes and the joints connecting the metatarsals with the phalanges. Midfoot region 102 generally includes portions of footwear 100 corresponding with the arch area of the foot, and heel region 103 corresponds with rear portions of the foot, including the calcaneus bone. Footwear 100 also includes a lateral side 104 and a medial side 105. Regions 101-103 and sides 104-105 are not intended to demarcate precise areas of footwear 100. Rather, regions 101-103 and sides 104-105 are intended to represent general areas of footwear 100 to aid in the following discussion. In addition to footwear 100 generally, references to the various regions 100-103 and sides 104-105 may also be applied to upper 110, sole structure 120, and individual elements thereof.

Sole structure 120 is secured to a lower area of upper 110 and is generally positioned between upper 110 and the ground, thereby extending between the foot and the ground. The primary elements of sole structure 120 are a plate 121, a midsole 122, and an outsole 123. In addition, sole structure 120 may incorporate an insole (not depicted) that is positioned within the interior void in upper 110 and located to correspond with a plantar (i.e., lower) surface of the foot, thereby enhancing the comfort of footwear 100.

Plate 121 extends between upper 110 and midsole 122 in at least heel region 103 and portions of midfoot region 102. Plate 121 exhibits a generally concave configuration to conform with the shape of the heel area of the foot, and plate 121 may form an upward protrusion in midfoot region 102 to support the arch area of the foot. Suitable materials for plate 121 include a variety of semi-rigid polymer materials, such as nylon and polyether block amide. Although plate 121 is depicted as having a generally concave configuration, plate 121 may also be planar or have other shapes within the scope of the present invention.

Midsole 122 is at least partially formed from a pair of midsole elements 124 and 130 that attenuate ground reaction forces (i.e., impart cushioning) and may control foot motions, such as pronation. Midsole element 124 is positioned in forefoot region 101 and extends into midfoot region 102. Similarly, midsole element 130 is positioned in heel region 103 and extends into midfoot region 102. Accordingly, midsole elements 124 and 130 effectively extend throughout the longitudinal length of footwear 100 (i.e., through each of regions 101-103), with plate 121 extending between midsole elements 124 and 130. Whereas midsole element 124 is secured directly to upper 110, midsole element 130 is secured to plate 121. In some embodiments of the invention, however, plate 121 may be absent such that midsole element 130 is secured directly to upper 110. Alternately, plate 121 may extend through the longitudinal length of footwear 100 such that each of midsole elements 124 and 130 are directly secured to plate 121. Suitable materials for midsole 122 include one or more polymer foam materials, such as ethylvinylacetate or polyurethane, that compress resiliently under an applied load to impart cushioning. The polymer foam materials forming midsole 122 may also absorb energy when compressed during ambulatory activities.

Outsole 123 is secured to a lower area of midsole 122 (i.e., to both of midsole elements 124 and 130) to form a lower surface of footwear 100, and outsole 123 extends through the longitudinal length of footwear 100. Suitable materials for outsole 123 include a variety of abrasion-resistant materials, such as carbon black rubber compound, that are textured to provide traction.

The structure of midsole element 130 will now be discussed in greater detail with reference to FIGS. 2-7B. Midsole element 130 is formed of unitary (i.e., one-piece) construction from a single density polymer foam material, but may also be formed from multiple elements that are joined together. In other embodiments, midsole element 130 may be formed to exhibit areas of different densities. For example, the portion of midsole element 130 in lateral side 104 may be formed from a more compressible foam than the portion of midsole element 130 in medial side 105.

Midsole element 130 forms four primary surfaces that include: an upper surface 131, a lower surface 132, an exterior surface 133, and an interior surface 134. Upper surface 131 has a generally concave shape that corresponds with the shape of plate 121, and upper surface 131 is positioned adjacent to plate 121 and secured to plate 121, with an adhesive, for example. In other embodiments, upper surface 131 may be planar or exhibit another shape. Lower surface 132 is positioned opposite upper surface 131 and has a generally planar configuration that joins with outsole 123. The rear-lateral area of lower surface 132 may have a bevel that facilitates contact between footwear 100 and the ground during the running cycle, as discussed in greater detail below. Exterior surface 133 extends between upper surface 131 and lower surface 132 to form an exterior of midsole element 130, thereby facing outward from footwear 100. The figures depict exterior surface 133 as having a generally smooth configuration, but exterior surface 133 may also exhibit a textured or ribbed configuration that enhances the compression properties of midsole element 130. Interior surface 134 also extends between upper surface 131 and lower surface 132, but is positioned on an interior of midsole element 130 to define a generally elliptical interior void 135.

Figure 5:
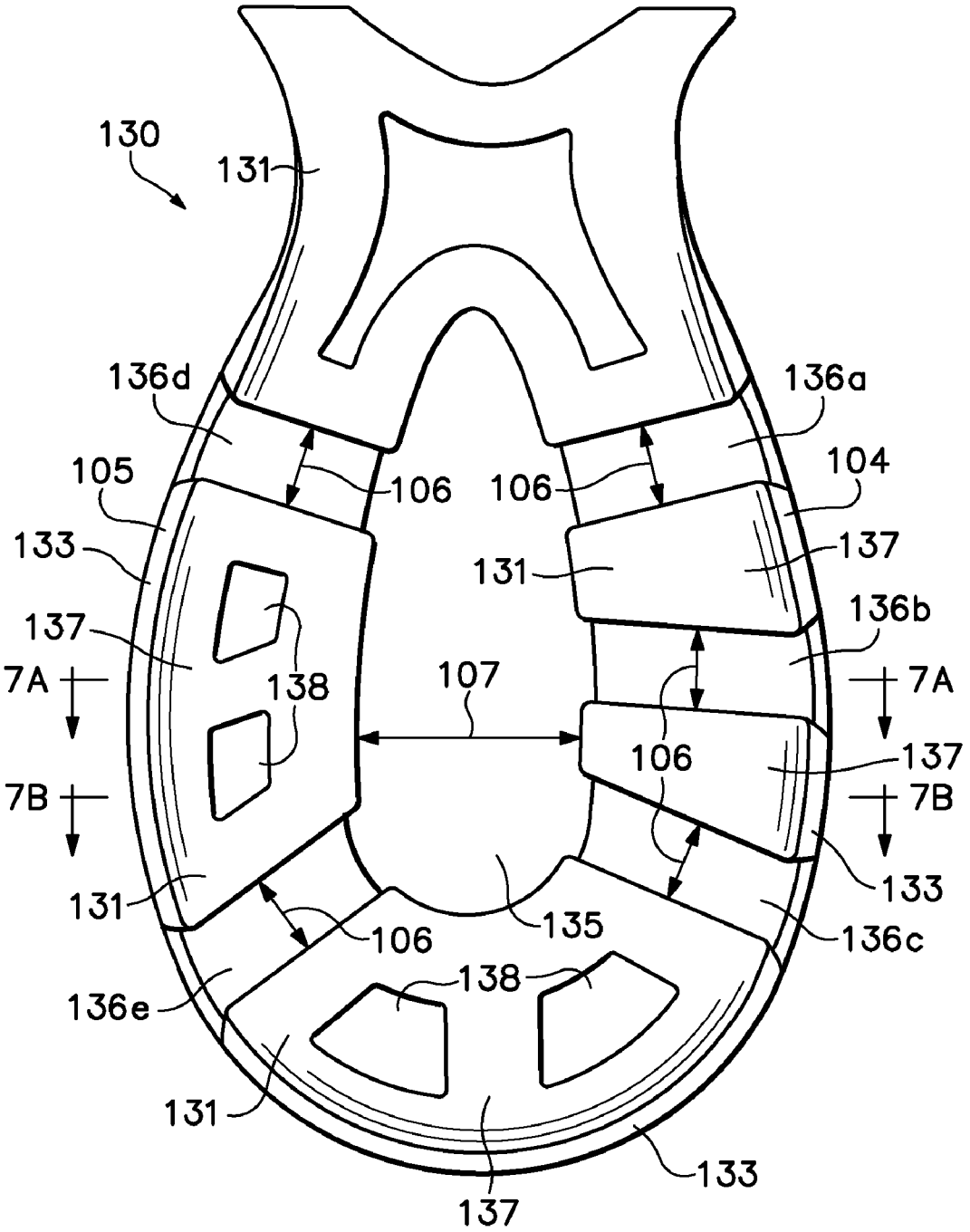
FIG. 5 is a top plan view of the first midsole element.
Figure 6:
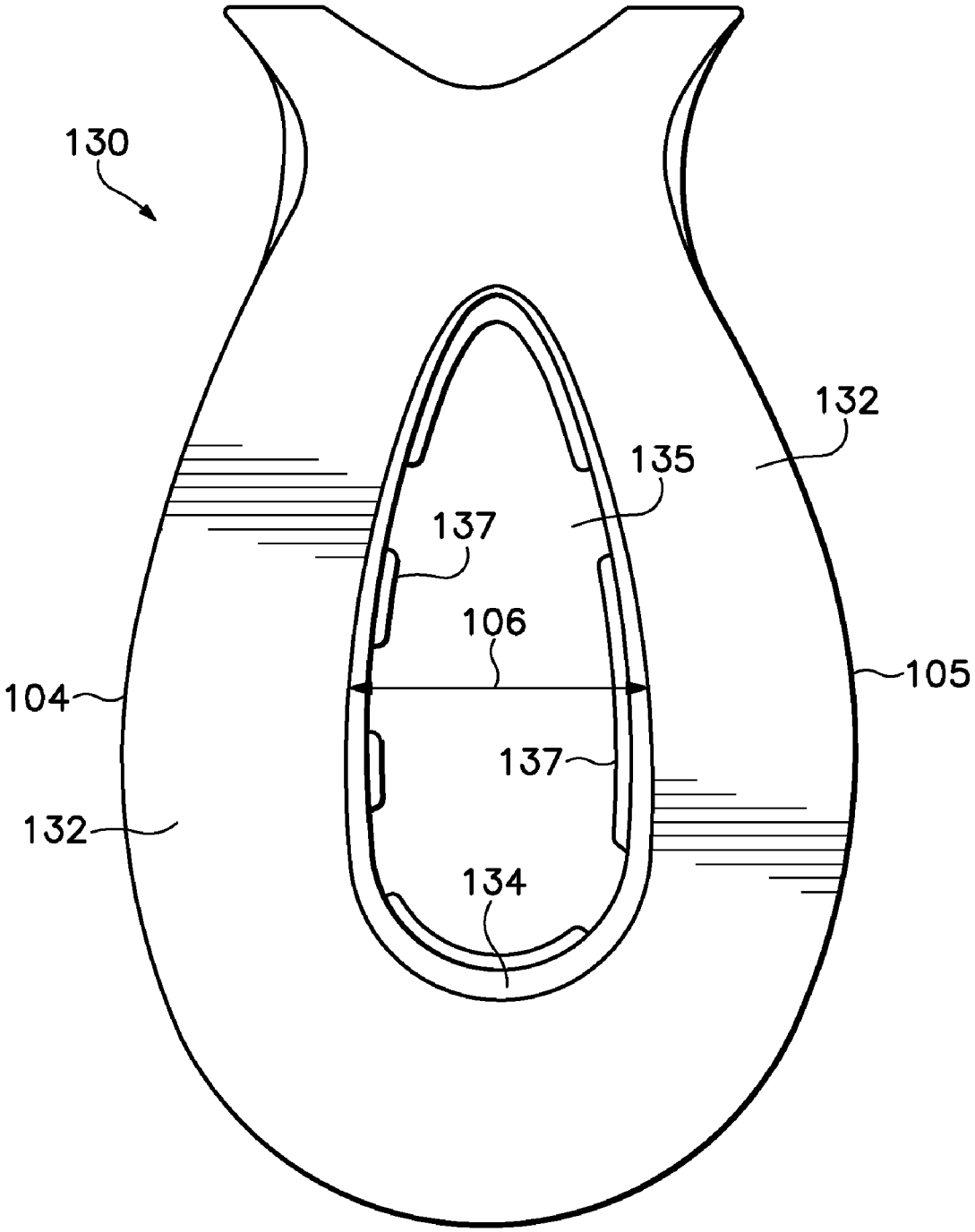
FIG. 6 is a bottom plan view of the first midsole element.

Interior void 135 extends vertically through midsole element 130 and between upper surface 131 and lower surface 132. Although the shape of interior void 135 may vary significantly within the scope of the present invention, interior void 135 is depicted in FIGS. 5 and 6 as having a generally elliptical configuration. In other embodiments, interior void 135 may be round, rectangular, or triangular, for example, or interior void 135 may have an irregular shape. Outsole 123 may define an aperture that corresponds with the position of interior void 135, thereby exposing plate 121 from a bottom of footwear 100. In other embodiments, outsole 123 may extend over the area of midsole element 130 that corresponds with interior void 135.

In addition to interior void 135, which extends vertically between upper surface 131 and lower surface 132, midsole element 130 also includes five bores 136*a*-136*e* that extend horizontally between exterior surface 133 and interior surface 134. More particularly, bores 136*a*-136*c* extend through lateral side 104, and bores 136*d*-136*e* extend through medial side 105. Bores 136*a*-136*e* are depicted in the figures as extending through upper surface 131 to form a plurality of individual columns 137 that contact and support portions of plate 121. In other embodiments, however, bores 136*a*-136*e* may form discrete and continuous apertures in midsole element 130 that do not break the continuity of upper surface 131.

Bores 136*a*-136*e* exhibit substantially constant width dimensions 106 from exterior surface 133 to interior surface 134. That is, the width dimensions 106 of bores 136*a*-136*e* do not increase or decrease substantially between exterior surface 133 and interior surface 134. In other words, bores 136*a*-136*e* are not depicted as tapering inward or flaring outward in the figures. In other embodiments of the invention, the width dimensions 106 of bores 136*a*-136*e* may vary between exterior surface 133 and interior surface 134. The substantially constant width dimensions 106 of bores 136*a*-136*e* from exterior surface 133 to interior surface 134 impart a generally trapezoidal shape to each of columns 137, as depicted in FIG. 5. More particularly, the lack of inward tapering and outward flaring in the width dimensions 106 of bores 136*a*-136*e* imparts a generally trapezoidal shape to the portions of upper surface 131 associated with the various columns 137, but the specific shape of upper surface 131 may vary considerably.

Another feature of bores 136*a*-136*e* relates to the relative dimensions of each of bores 136*a*-136*e*. As discussed above, bores 136*a*-136*e* exhibit substantially constant width dimensions 106. In addition, the width dimension 106 of each of bores 136*a*-136*e* is substantially similar to the width dimension 106 of other bores 136*a*-136*e*. More particularly, the width dimension of bore 136*a* is substantially similar to the width dimension of bore 136*c*, and the width dimension of bore 136*b* is substantially similar to the width dimension of bore 136*d*, for example. In other embodiments of the invention, the relative width dimensions of the various bores 136*a*-136*e* may vary.

The relative number of bores 136*a*-136*e* through lateral side 104 and medial side 105, and the resulting number of columns 137, are selected to correspond with a common motion of the foot during running, which proceeds as follows: Initially, the heel strikes the ground, followed by the ball of the foot. As the heel leaves the ground, the foot rolls forward so that the toes make contact, and finally the entire foot leaves the ground to begin another cycle. During the time that the foot is in contact with the ground and rolling forward, it also rolls from the outside or lateral side to the inside or medial side, a process called pronation. While the foot is air-borne and preparing for another cycle, the opposite process, called supination, occurs.

Footwear 100 may be structured to exhibit lesser compressibility on medial side 105 when compared with lateral side 104 in order to limit the degree of pronation in the foot. In other words, medial side 105 is less compressible to resist medial roll in the foot. The lesser compressibility of medial side 105 is imparted through the relative number of bores 136*a*-136*e* through lateral side 104 and medial side 105, and the resulting number of columns 137. More particularly, three bores 136*a*-136*c* extend through lateral side 104, and two bores 136*d*-136*e* extend through medial side 105. The difference in the number of bores 136*a*-136*e* forms a differential in the compressibility of lateral side 104 and medial side 105. That is, lateral side 104 is more compressible than medial side 105 due to the difference in the number of bores 136*a*-136*e*.

Differences in the degree of compressibility between lateral side 104 and medial side 105 are at least partially dependent upon various factors, including the dimensions of bores 136*a*-136*e*, the number of bores 136*a*-136*e*, and the properties of the material forming midsole element 130. Differences in the degree of compressibility between lateral side 104 and medial side 105 may also be controlled through the formation of one or more cavities 138 in one or more columns 137. With reference to FIG. 5, for example, the column 137 positioned in medial side 105 defines two cavities 138, where as the columns 137 positioned in lateral side 104 do not define cavities 138. Accordingly, only selected columns 137 may incorporate cavities 138, and in some embodiments no columns 137 may incorporate cavities 138. Cavities 138 are depicted as being substantially vertical, but may have other orientations. In addition, cavities 138 may extend through lower surface 132.

Although medial side 105 is intended to have lesser compressibility than lateral side 104, cavities 138 may increase the compressibility of medial side 105 to further tune the difference in compressibility between lateral side 104 and medial side 105. A pair of cavities 138 are also formed in the column 137 that forms a rear area of midsole element 130. These cavities 138 may decrease the compressibility of midsole element 130 in the area of sole structure 120 that compresses during the initial contact between footwear 100 and the ground during the running cycle. The various cavities 138 are depicted as not extending through lower surface 132, but may extend through one or both of surfaces 131 and 132 in further embodiments of the invention.

The polymer foam material of midsole element 130, as depicted in the figures, encompasses approximately two-thirds of the distance between lateral side 104 and medial side 105, and a dimension 107 across interior void 135 (also in the direction between lateral side 104 and medial side 105) encompasses approximately one-third of the distance between lateral side 104 and medial side 105. As depicted in the figures, therefore, the ratio of the distance between lateral side 104 and medial side 105 to dimension 107 is approximately 3:1. In further embodiments of the invention, the ratio may vary significantly, but will generally be in a range of 1.5:1 to 9:1. Accordingly, the ratio will generally be greater than 1.5:1 and may be, therefore 2:1, 3:1, 4:1, or 5:1, for example.

Figure 2:
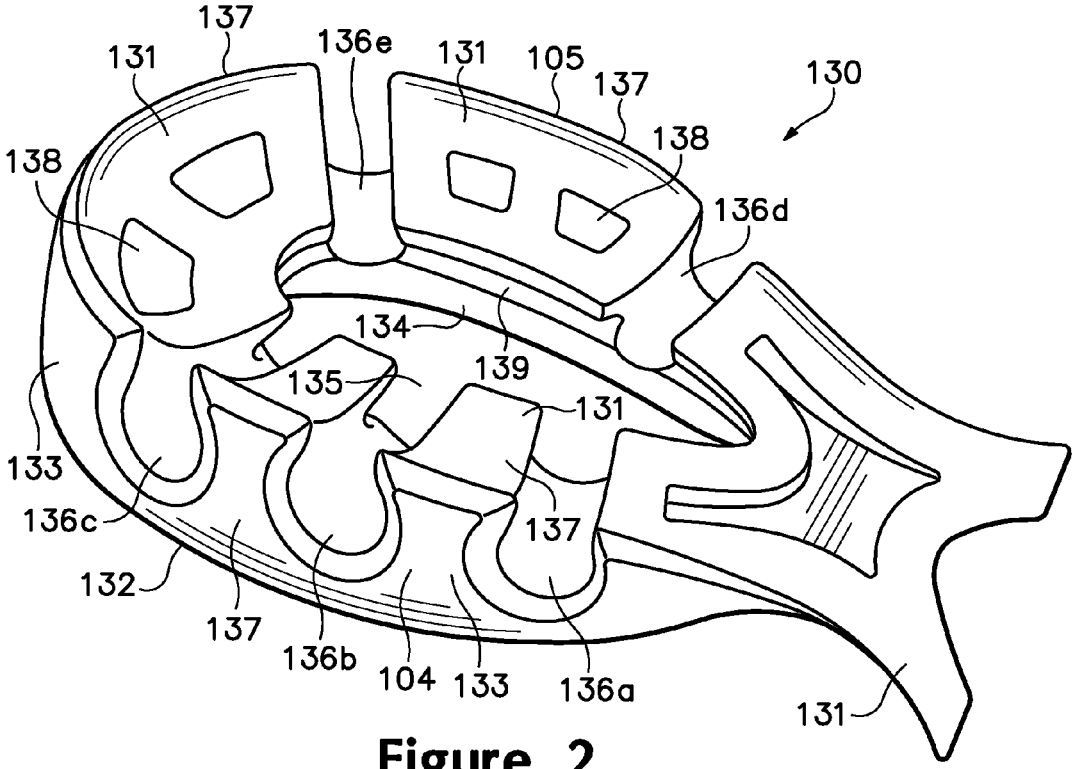
FIG. 2 is a perspective view of the first midsole element.
Figure 7A:
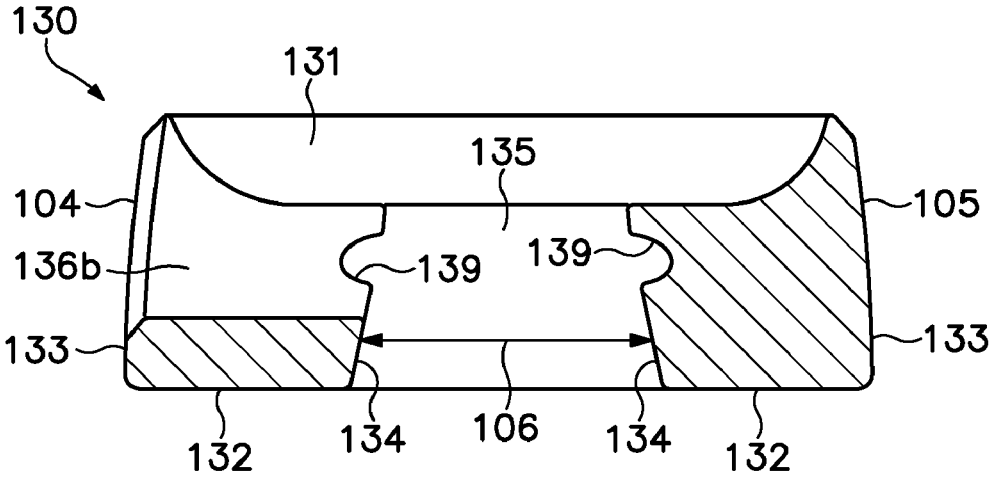
FIG. 7A is a first cross-sectional view of the first midsole element, as defined by section line 7A-7A in FIG. 5.
Figure 7B:
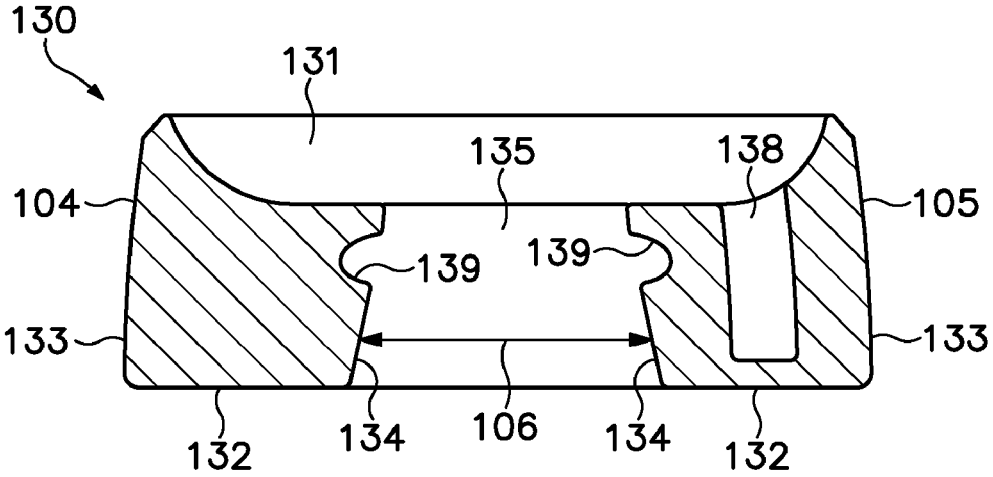
FIG. 7B is a second cross-sectional view of the first midsole element, as defined by section line 7B-7B in FIG. 5.
Figure 8:
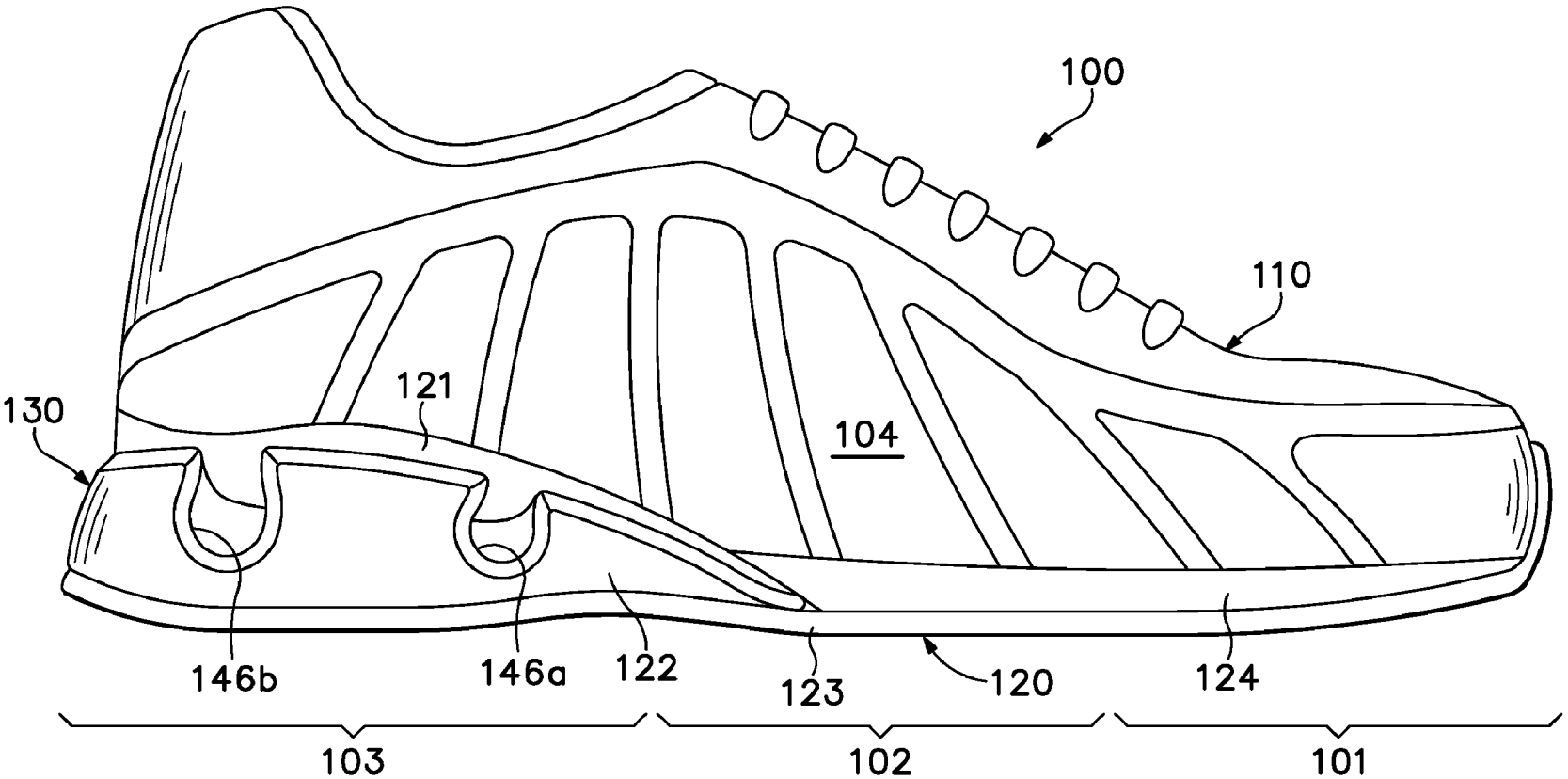
FIG. 8 is a lateral side elevational view of an article of footwear having a second midsole element in accordance with the present invention.
Figure 9:
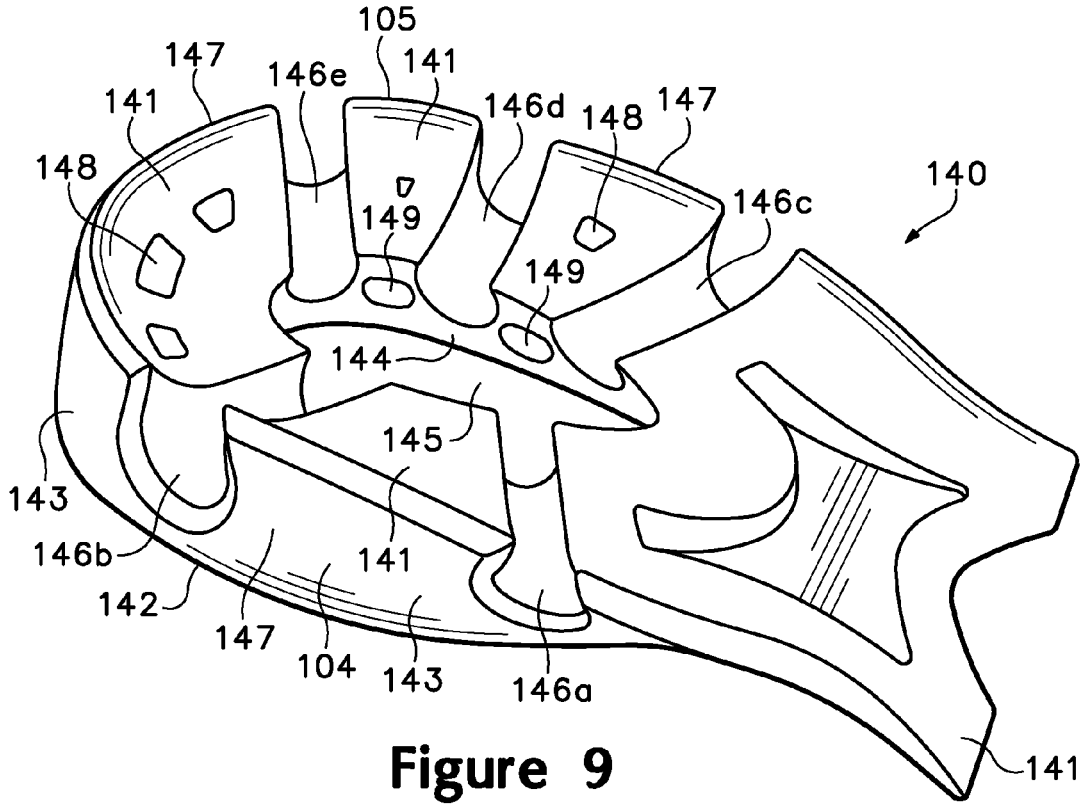
FIG. 9 is a perspective view of the second midsole element.

An indentation 139 circumscribes at least a portion of interior surface 134, as depicted in FIGS. 2, 7A, and 7B. Indentation 139 also affects the compressibility of midsole element 130. In effect, indentation 139 increases the compressibility of the portions of midsole element 130 that are adjacent to interior surface 134. That is, indentation 139 increases the compressibility of central areas of midsole element 130 relative to outer areas, which may promote stability in footwear 100. As depicted in the figures, indentation 139 exhibits a semi-circular configuration, but indentation 139 may have a variety of configurations within the scope of the present invention. Although indentation 139 is depicted as extending around substantially all of midsole element 139, indentation 139 may be limited to heel region 103 or may be absent is some embodiments of the invention.

Figure 3:
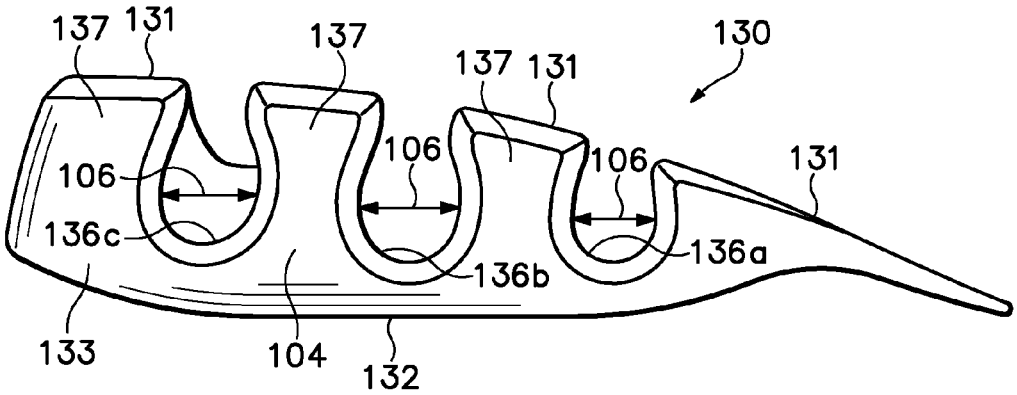
FIG. 3 is a lateral side elevational view of the first midsole element.
Figure 4:
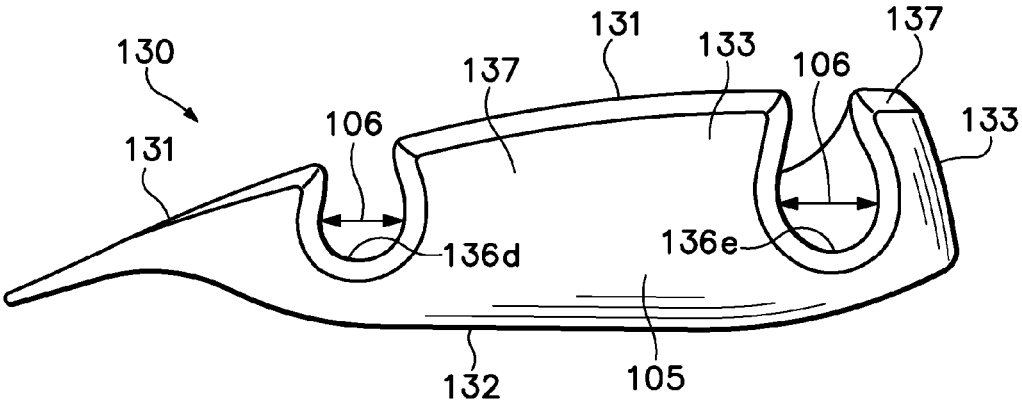
FIG. 4 is a medial side elevational view of the first midsole element.

With reference to FIGS. 3 and 4, midsole element 130 tapers downward from the rearward areas to the areas that are positioned in midfoot region 102. The heel areas of some articles of footwear are at a greater elevation than forefoot areas, particularly in athletic footwear. The downward taper facilitates this configuration in footwear 100. In addition, the downward taper forms a wedge-shaped portion of midsole element 130 that extends between plate 121 and outsole 123 in midfoot region 102 and is generally positioned under the arch area of the foot.

Midsole element 130 is depicted as being positioned in heel region 103 and extending into midfoot region 102. In further embodiments of the invention, midsole element 130 may be limited to heel region 103, or midsole element 130 may extend into forefoot region 101. Accordingly, the concepts disclosed herein may be applied to various areas and components of midsole 122.

Based upon the above discussion, midsole element 130 incorporates a variety of features. For example, midsole element 130 may be formed of unitary construction from a single density foam, but may also be formed from foams of different density. In addition, the number of bores 136*a*-136*e* may vary between lateral side 104 and medial side 105, and some or all of bores 136*a*-136*e* may exhibit substantially constant width dimensions 106 from exterior surface 133 to interior surface 134. Bores 136*a*-136*e* may also impart a trapezoidal shape to the various columns 137. Furthermore, some or all of columns 137 may define cavities 138 that further affect the compressibility of specific areas of midsole element 130.

SECOND EMBODIMENT

The above discussion of footwear 100 provides an example of the various configurations that are suitable for midsole element 130. With reference to FIGS. 8-14B, however, article of footwear 100 is depicted with a different midsole element 140 that configures footwear 100 for training activities. Midsole element 140 is formed of unitary (i.e., one-piece) construction from a single density polymer foam material, but may also be formed from multiple elements that are joined together. In other embodiments, midsole element 140 may be formed from two different foams having different densities. For example, the portion of midsole element 140 in lateral side 104 may be formed from a more compressible foam than the portion of midsole element 140 in medial side 105.

Midsole element 140 forms four primary surfaces that include: an upper surface 141, a lower surface 142, an exterior surface 143, and an interior surface 144. Upper surface 141 has a generally concave shape that corresponds with the shape of plate 121, and upper surface 141 is positioned adjacent to plate 121 and secured to plate 121, with an adhesive, for example. Lower surface 142 is positioned opposite upper surface 141 and has a generally planar configuration that joins with outsole 123. Exterior surface 143 extends between upper surface 141 and lower surface 142 to form an exterior of midsole element 140, thereby facing outward from footwear 100. The figures depict exterior surface 143 as having a generally smooth configuration, but exterior surface 143 may also exhibit a textured or ribbed configuration that enhances the compression properties of midsole element 140. Interior surface 144 also extends between upper surface 141 and lower surface 142, but is positioned on an interior of midsole element 140 to define a generally elliptical interior void 145.

Figure 12:
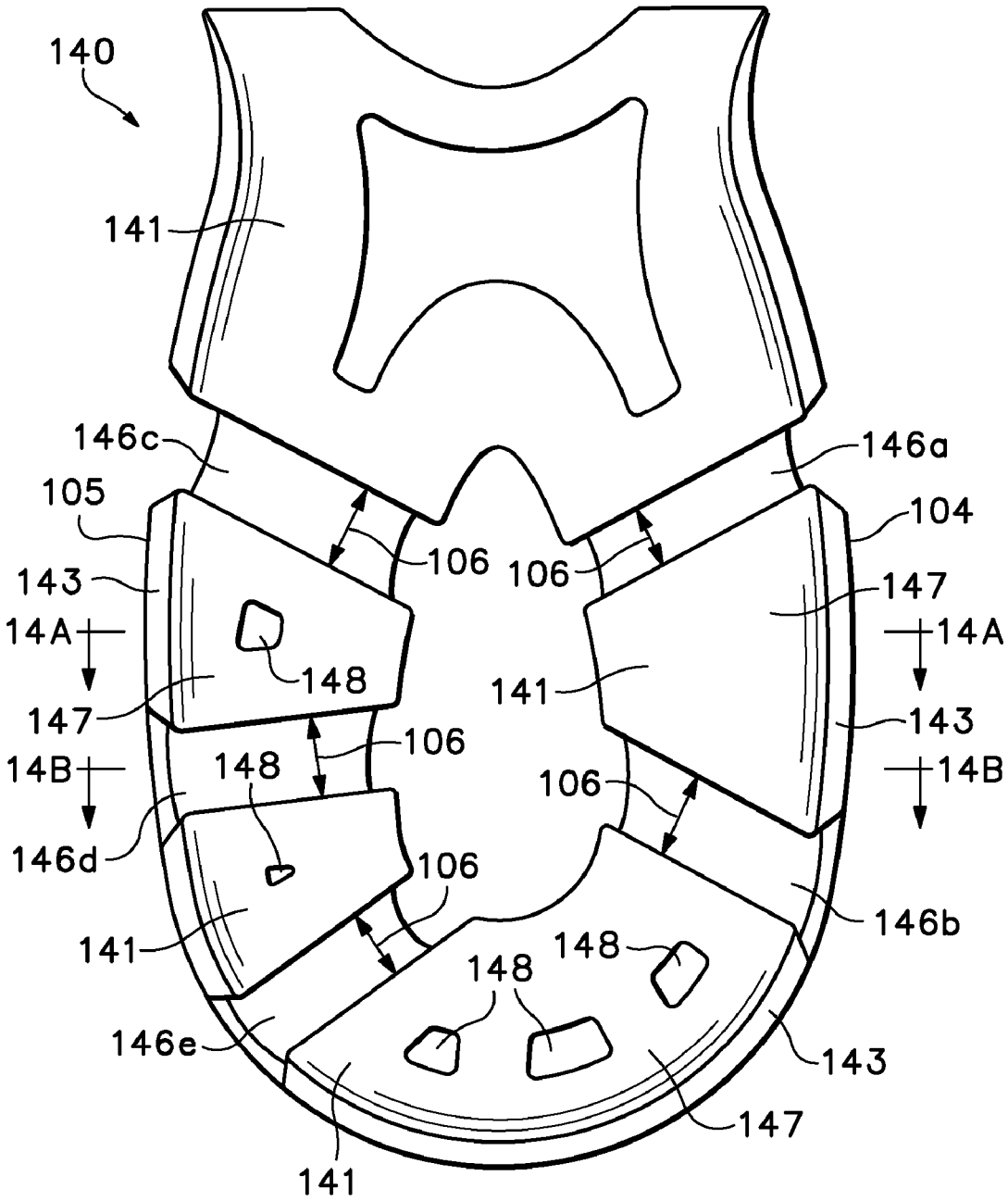
FIG. 12 is a top plan view of the second midsole element.
Figure 13:
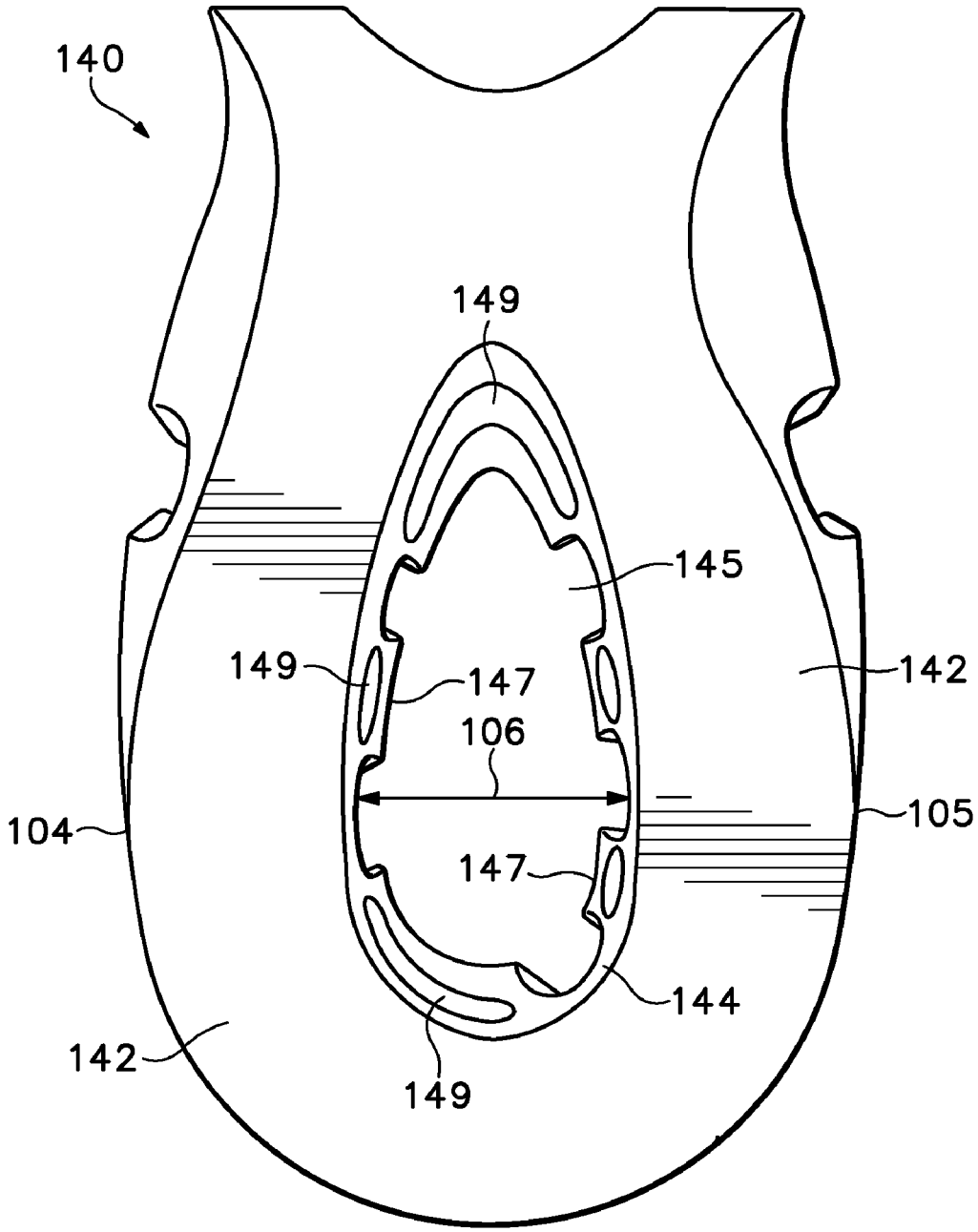
FIG. 13 is a bottom plan view of the second midsole element.
Figure 14A:
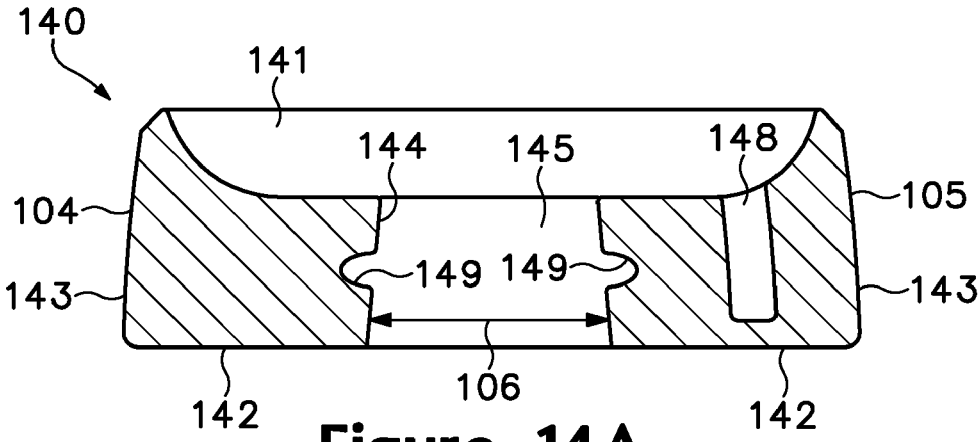
FIG. 14A is a first cross-sectional view of the second midsole element, as defined by section line 14A-14A in FIG. 12.
Figure 14B:
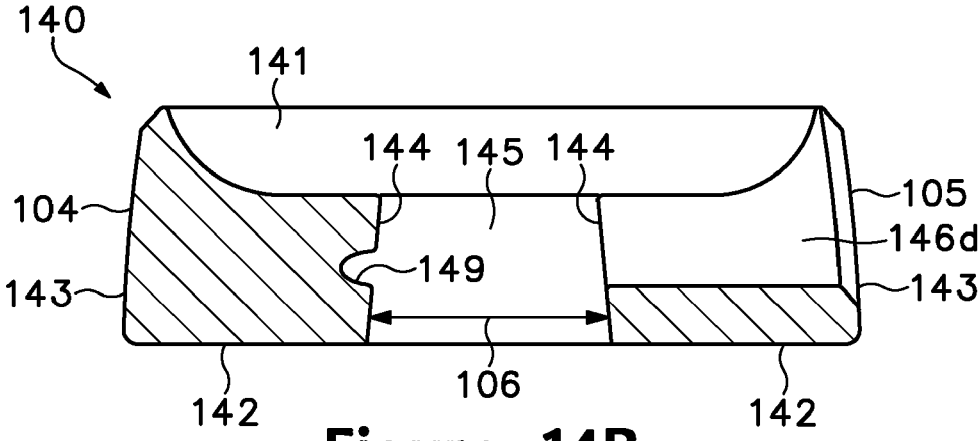
FIG. 14B is a second cross-sectional view of the second midsole element, as defined by section line 14B-14B in FIG. 12.
Figure 15:
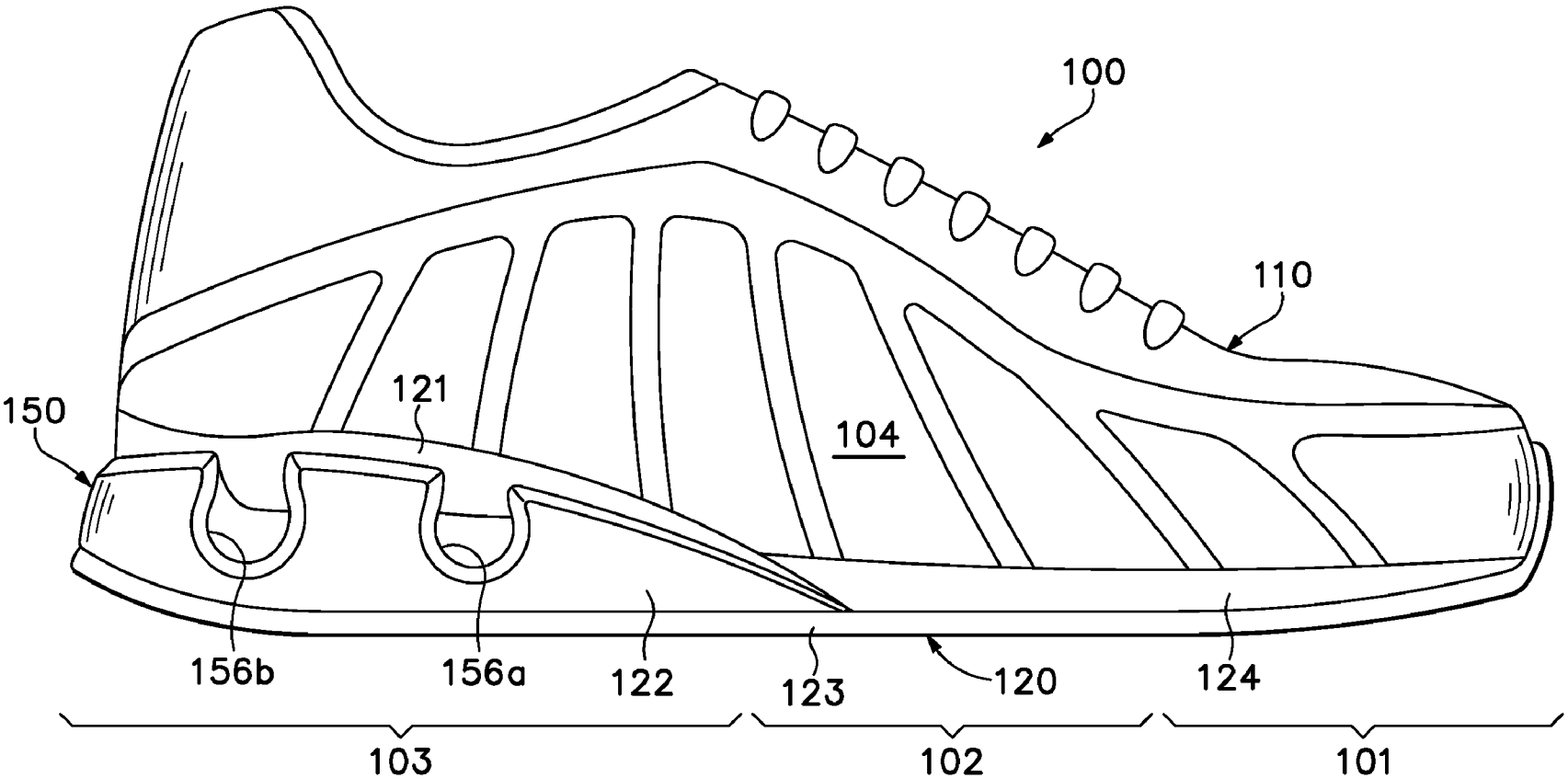
FIG. 15 is a lateral side elevational view of an article of footwear having a third midsole element in accordance with the present invention.

Interior void 145 extends vertically through midsole element 140 and between upper surface 141 and lower surface 142. Although the shape of interior void 145 may vary significantly within the scope of the present invention, interior void 145 is depicted in FIGS. 12 and 13 as having a generally elliptical configuration. In other embodiments, interior void 145 may be round, rectangular, or triangular, for example, or interior void 145 may have an irregular shape. Outsole 123 may form an aperture that corresponds with the position of interior void 145, thereby exposing plate 121 from a bottom of footwear 100. In other embodiments, outsole 123 may extend over the area of midsole element 140 that corresponds with interior void 145.

In addition to interior void 145, which extends vertically between upper surface 141 and lower surface 142, midsole element 140 also includes five bores 146*a*-146*e* that extend horizontally between exterior surface 143 and interior surface 144. More particularly, bores 146*a*-146*b* extend through lateral side 104, and bores 146*c*-146*e* extend through medial side 105. Bores 146*a*-146*e* are depicted in the figures as extending through upper surface 141 to form a plurality of individual columns 147 that contact and support portions of plate 121. In other embodiments, however, bores 146*a*-146*e* may form discrete and continuous apertures in midsole element 140 that do not break the continuity of upper surface 141.

Bores 146*a*-146*e* exhibit substantially constant width dimensions 106 from exterior surface 143 to interior surface 144. That is, the width dimensions 106 of bores 146*a*-146*e* do not increase or decrease substantially between exterior surface 143 and interior surface 144. In other words, bores 146*a*-146*e* are not depicted as tapering inward or flaring outward in the figures. In other embodiments of the invention, the width dimensions 106 of bores 146*a*-146*e* may vary between exterior surface 143 and interior surface 144. The substantially constant width dimensions 106 of bores 146*a*-146*e* from exterior surface 143 to interior surface 144 impart a generally trapezoidal shape to each of columns 147, as depicted in FIG. 12. More particularly, the lack of inward tapering and outward flaring in the width dimensions 106 of bores 146*a*-146*e* imparts a generally trapezoidal shape to the portions of upper surface 141 associated with the various columns 147.

Another feature of bores 146*a*-146*e* relates to the relative dimensions of each of bores 146*a*-146*e*. As discussed above, bores 146*a*-146*e* exhibit substantially constant width dimensions 106. In addition, the width dimension 106 of each of bores 146*a*-146*e* is substantially similar to the width dimension 106 of other bores 146*a*-146*e*. More particularly, the width dimension of bore 146*a* is substantially similar to the width dimension of bore 146*c*, and the width dimension of bore 146*b* is substantially similar to the width dimension of bore 146*d*, for example. In other embodiments of the invention, the relative width dimensions of the various bores 146*a*-146*e* may vary.

The relative number of bores 146*a*-146*e* through lateral side 104 and medial side 105, and the resulting number of columns 147, are selected to impart a compressibility to portions of midsole element 140 that is advantageous during training activities. More particularly, two bores 146*a*-146*b* extend through lateral side 104, and three bores 146*c*-146*e* extend through medial side 105. The difference in the number of bores 146*a*-146*e* forms a differential in the compressibility of lateral side 104 and medial side 105.

Differences in the degree of compressibility between lateral side 104 and medial side 105 are at least partially dependent upon various factors, including the dimensions of bores 146*a*-146*e*, the number of bores 146*a*-146*e*, and the properties of the material forming midsole element 140. Differences in the degree of compressibility between lateral side 104 and medial side 105 may also be controlled through the formation of one or more cavities 148 in one or more columns 147. With reference to FIG. 12, for example, each of the columns 147 positioned in medial side 105 defines one cavity 148, where as the column 147 positioned in lateral side 104 does not define a cavity 148. Accordingly, only selected columns 147 may incorporate cavities 148, and in some embodiments no columns 147 may incorporate cavities 148.

Cavities 148 may increase the compressibility of medial side 105 to further tune the difference in compressibility between lateral side 104 and medial side 105. Three cavities 148 are also formed in the column 147 that forms a rear area of midsole element 140. These cavities 148 may decrease the compressibility of midsole element 140 in the area of sole structure 120 that compresses during the initial contact between footwear 100 and the ground during the running cycle. The various cavities 148 are depicted as not extending through lower surface 142, but may extend through one or both of surfaces 141 and 142 in further embodiments of the invention.

The polymer foam material of midsole element 140, as depicted in the figures, encompasses approximately two-thirds of the distance between lateral side 104 and medial side 105, and a dimension 107 across interior void 145 (also in the direction between lateral side 104 and medial side 105) encompasses approximately one-third of the distance between lateral side 104 and medial side 105. As depicted in the figures, therefore, the ratio of the distance between lateral side 104 and medial side 105 to dimension 107 is approximately 3:1. In further embodiments of the invention, the ratio may vary significantly, but will generally be in a range of 1.5:1 to 9:1. Accordingly, the ratio will generally be greater than 1.5:1 and may be, therefore 2:1, 3:1, 4:1, or 5:1, for example.

A plurality of indentations 149 are formed in interior surface 144, as depicted in FIGS. 9, 13, 7A, and 7B. Indentations 149 also affect the compressibility of midsole element 140. In effect, indentations 149 increase the compressibility of the portions of midsole element 140 that are adjacent to interior surface 144. That is, indentations 149 increase the compressibility of central areas of midsole element 140 relative to outer areas, which may promote stability in footwear 100. As depicted in the figures, indentations 149 are elongate or elliptical and exhibit a semi-circular cross-section, but indentation 149 may have a variety of configurations within the scope of the present invention. Although indentation 149 is depicted as extending around substantially all of midsole element 149, indentation 149 may be limited to heel region 103 or may be absent is some embodiments of the invention.

Figure 10:
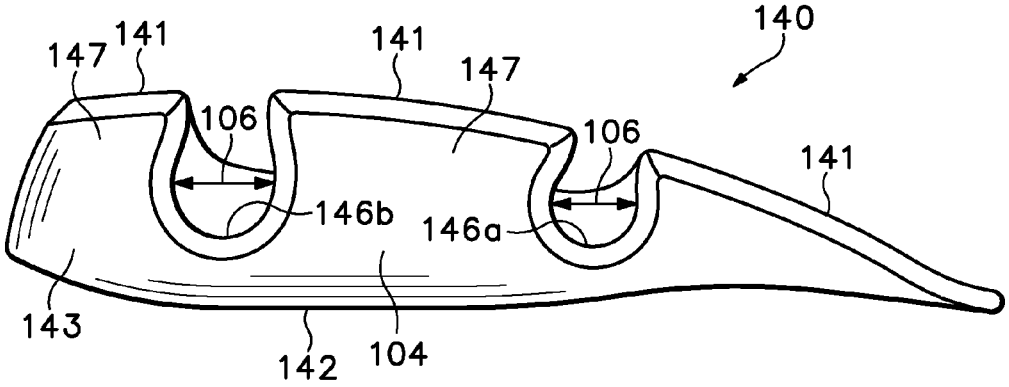
FIG. 10 is a lateral side elevational view of the second midsole element.
Figure 11:
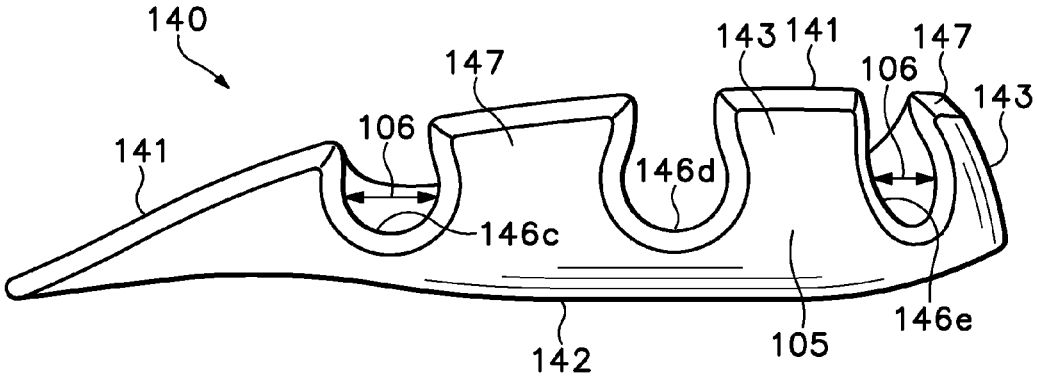
FIG. 11 is a medial side elevational view of the second midsole element.

With reference to FIGS. 10 and 11, midsole element 140 tapers downward from the rearward areas to the areas that are positioned in midfoot region 102. The heel areas of some articles of footwear are at a greater elevation than forefoot areas, particularly in athletic footwear. The downward taper facilitates this configuration in footwear 100. In addition, the downward taper forms a wedge-shaped portion of midsole element 140 that extends between plate 121 and outsole 123 in midfoot region 102 and is generally positioned under the arch area of the foot.

Midsole element 140 is depicted as being positioned in heel region 103 and extending into midfoot region 102. In further embodiments of the invention, midsole element 140 may be limited to heel region 103, or midsole element 140 may extend into forefoot region 101. Accordingly, the concepts disclosed herein may be applied to various areas and components of midsole 122.

Based upon the above discussion, midsole element 140 incorporates a variety of features. For example, midsole element 140 may be formed of unitary construction from a single density foam, but may also be formed from foams of different density. In addition, the number of bores 146*a*-146*e* may vary between lateral side 104 and medial side 105, and some or all of bores 146*a*-146*e* may exhibit substantially constant width dimensions 106 from exterior surface 143 to interior surface 144. Bores 146*a*-146*e* may also impart a trapezoidal shape to the various columns 147. Furthermore, some or all of columns 147 may define cavities 148 that further affect the compressibility of specific areas of midsole element 140.

THIRD EMBODIMENT

The above discussion of midsole elements 130 and 140 provide features of footwear 100 when configured for running or training activities, for example. With reference to FIGS. 15-21B, however, article of footwear 100 is depicted with another midsole element 150 that configures footwear 100 for walking activities. Midsole element 150 is formed of unitary (i.e., one-piece) construction from a single density polymer foam material, but may also be formed from multiple elements that are joined together. In other embodiments, midsole element 150 may be formed from two different foams having different densities. For example, the portion of midsole element 150 in lateral side 104 may be formed from a more compressible foam than the portion of midsole element 140 in medial side 105.

Midsole element 150 forms four primary surfaces that include: an upper surface 151, a lower surface 152, an exterior surface 153, and an interior surface 154. The figures depict exterior surface 153 as having a generally smooth configuration, but exterior surface 153 may also exhibit a textured or ribbed configuration that enhances the compression properties of midsole element 150. Upper surface 151 has a generally concave shape that corresponds with the shape of plate 121, and upper surface 151 is positioned adjacent to plate 121 and secured to plate 121, with an adhesive, for example. Lower surface 152 is positioned opposite upper surface 151 and has a generally planar configuration that joins with outsole 123. Exterior surface 153 extends between upper surface 151 and lower surface 152 to form an exterior of midsole element 150, thereby facing outward from footwear 100. Interior surface 154 also extends between upper surface 151 and lower surface 152, but is positioned on an interior of midsole element 150 to define a generally elliptical interior void 155.

Figure 17:
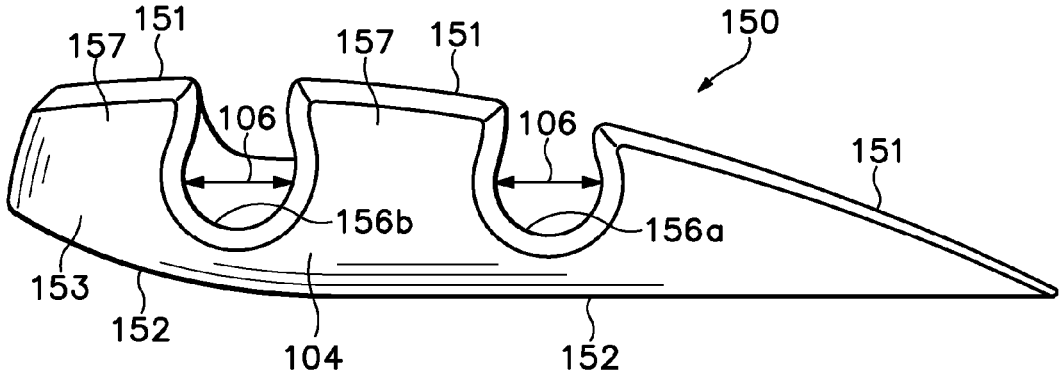
FIG. 17 is a lateral side elevational view of the third midsole element.
Figure 18:
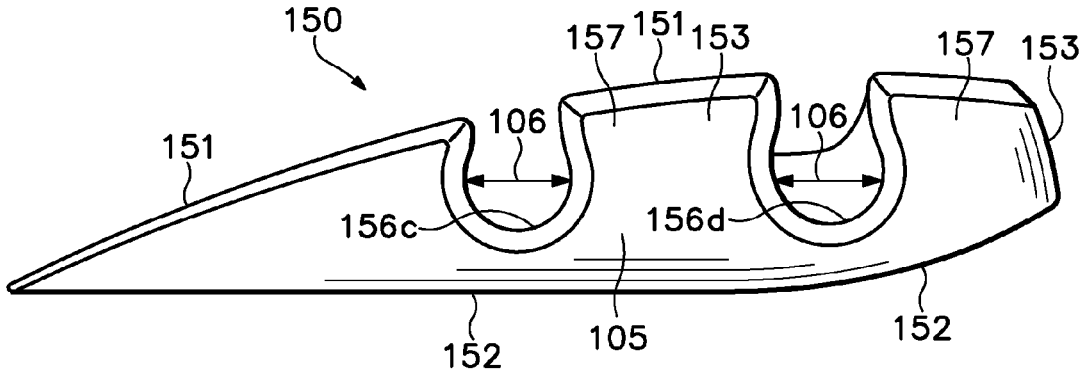
FIG. 18 is a medial side elevational view of the third midsole element.

Interior void 155 extends vertically through midsole element 150 and between upper surface 151 and lower surface 152. Although the shape of interior void 155 may vary significantly within the scope of the present invention, interior void 155 is depicted in FIGS. 17 and 18 as having a generally elliptical configuration. In other embodiments, interior void 155 may be round, rectangular, or triangular, for example, or interior void 155 may have an irregular shape. Outsole 123 may form an aperture that corresponds with the position of interior void 155, thereby exposing plate 121 from a bottom of footwear 100. In other embodiments, outsole 123 may extend over the area of midsole element 150 that corresponds with interior void 155.

In addition to interior void 155, which extends vertically between upper surface 151 and lower surface 152, midsole element 150 also includes four bores 156*a*-156*d* that extend horizontally between exterior surface 153 and interior surface 154. More particularly, bores 156*a*-156*b* extend through lateral side 104, and bores 156*c*-156*d* extend through medial side 105. Bores 156*a*-156*d* are depicted in the figures as extending through upper surface 151 to form a plurality of individual columns 157 that contact and support portions of plate 121. In other embodiments, however, bores 156*a*-156*d* may form discrete and continuous apertures in midsole element 150 that do not break the continuity of upper surface 151.

Figure 19:
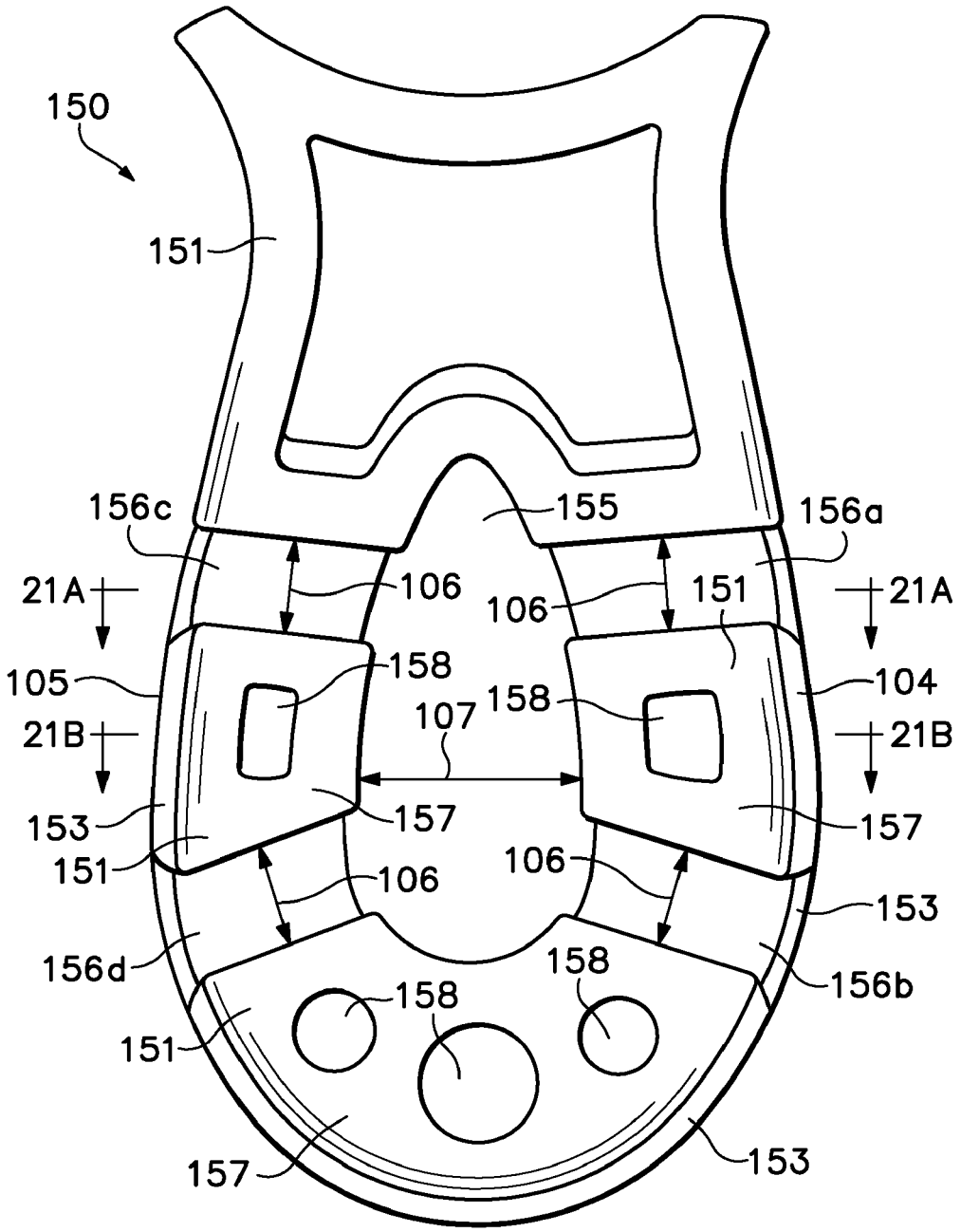
FIG. 19 is a top plan view of the third midsole element.
Figure 20:
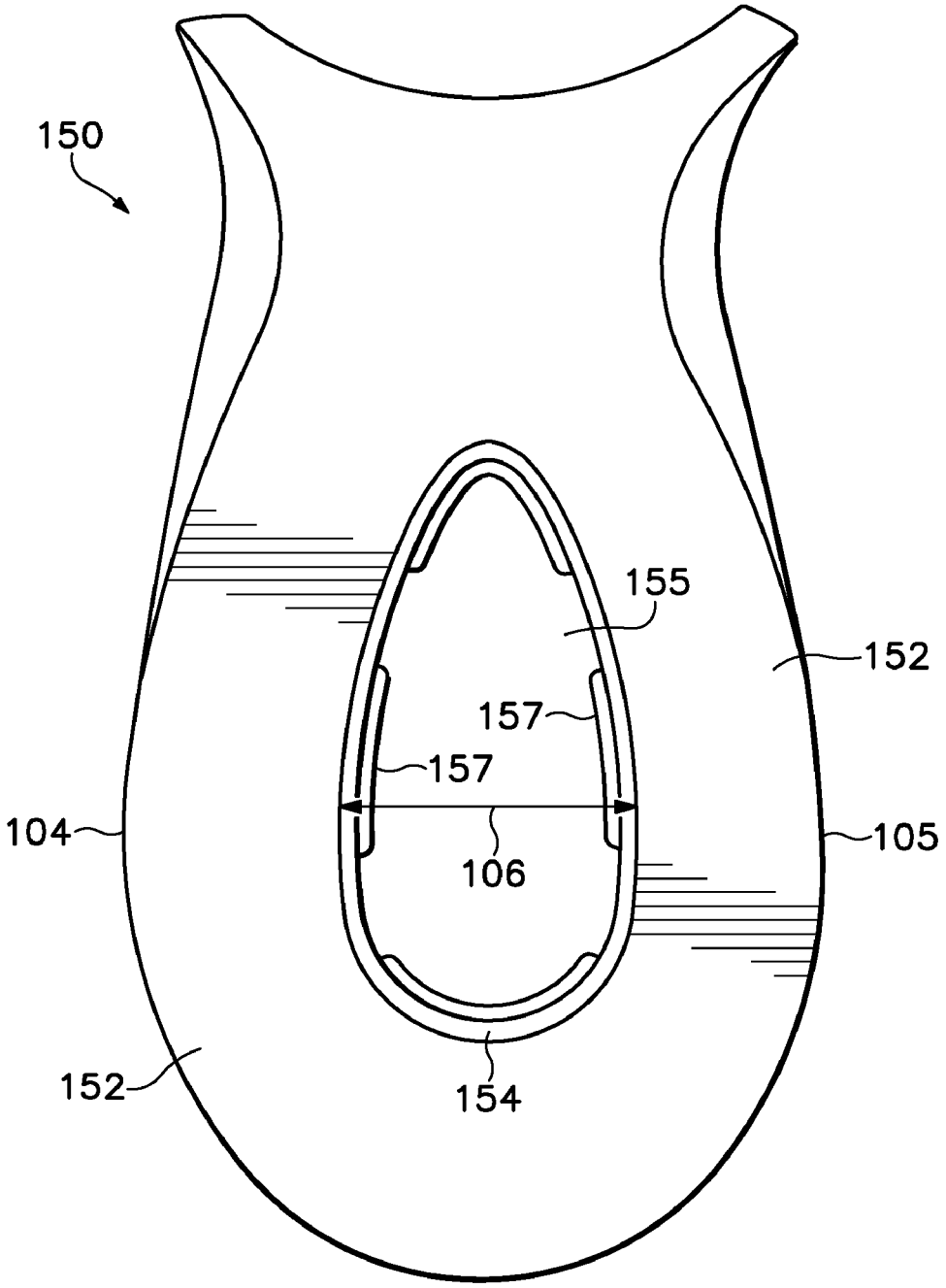
FIG. 20 is a bottom plan view of the third midsole element.

Bores 156*a*-156*d* exhibit substantially constant width dimensions 106 from exterior surface 153 to interior surface 154. That is, the width dimensions 106 of bores 156*a*-156*d* do not increase or decrease substantially between exterior surface 153 and interior surface 154. In other words, bores 156*a*-156*d* are not depicted as tapering inward or flaring outward in the figures. In other embodiments of the invention, the width dimensions 106 of bores 156*a*-156*d* may vary between exterior surface 153 and interior surface 154. The substantially constant width dimensions 106 of bores 156*a*-156*d* from exterior surface 153 to interior surface 154 impart a generally trapezoidal shape to each of columns 157, as depicted in FIG. 19. More particularly, the lack of inward tapering and outward flaring in the width dimensions 106 of bores 156*a*-156*d* imparts a generally trapezoidal shape to the portions of upper surface 151 associated with the various columns 157.

Another feature of bores 156*a*-156*e* relates to the relative dimensions of each of bores 156*a*-156*e*. As discussed above, bores 156*a*-156*e* exhibit substantially constant width dimensions 106. In addition, the width dimension 106 of each of bores 156*a*-156*e* is substantially similar to the width dimension 106 of other bores 156*a*-156*e*. More particularly, the width dimension of bore 156*a* is substantially similar to the width dimension of bore 156*c*, and the width dimension of bore 156*b* is substantially similar to the width dimension of bore 156*d*, for example. In other embodiments of the invention, the relative width dimensions of the various bores 156*a*-156*e* may vary.

The relative number of bores 156*a*-156*d* through lateral side 104 and medial side 105, and the resulting number of columns 157, are selected to impart a compressibility to portions of midsole element 150 that is advantageous during walking activities. During walking activities, the degree of pronation in the foot is significantly reduced when compared with the degree of pronation during the running cycle. Accordingly, midsole element 150 may exhibit an equal number of bores 156*a*-156*d* on each of lateral side 104 and medial side 105. That is, midsole element 150 may have a substantially symmetrical shape that does not impart differences in the degree of compressibility between lateral side 104 and medial side 105.

As with midsole elements 130 and 140, one or more cavities 158 may be formed in one or more columns 157. With reference to FIG. 19, for example, the columns 157 positioned in lateral side 104 and medial side 105 each define a single cavity 158, and the column 157 that forms a rear area of midsole element 150 may define three cavities 158. These cavities 158 may decrease the compressibility of midsole element 150 in the area of sole structure 120 that compresses during the initial contact between footwear 100 and the ground during walking activities. The various cavities 158 are depicted as not extending through lower surface 152, but may extend through one or both of surfaces 151 and 152 in further embodiments of the invention.

The polymer foam material of midsole element 150, as depicted in the figures, encompasses approximately two-thirds of the distance between lateral side 104 and medial side 105, and a dimension 107 across interior void 155 (also in the direction between lateral side 104 and medial side 105) encompasses approximately one-third of the distance between lateral side 104 and medial side 105. As depicted in the figures, therefore, the ratio of the distance between lateral side 104 and medial side 105 to dimension 107 is approximately 3:1. In further embodiments of the invention, the ratio may vary significantly, but will generally be in a range of 1.5:1 to 9:1. Accordingly, the ratio will generally be greater than 1.5:1 and may be, therefore 2:1, 3:1, 4:1, or 5:1, for example.

Figure 16:
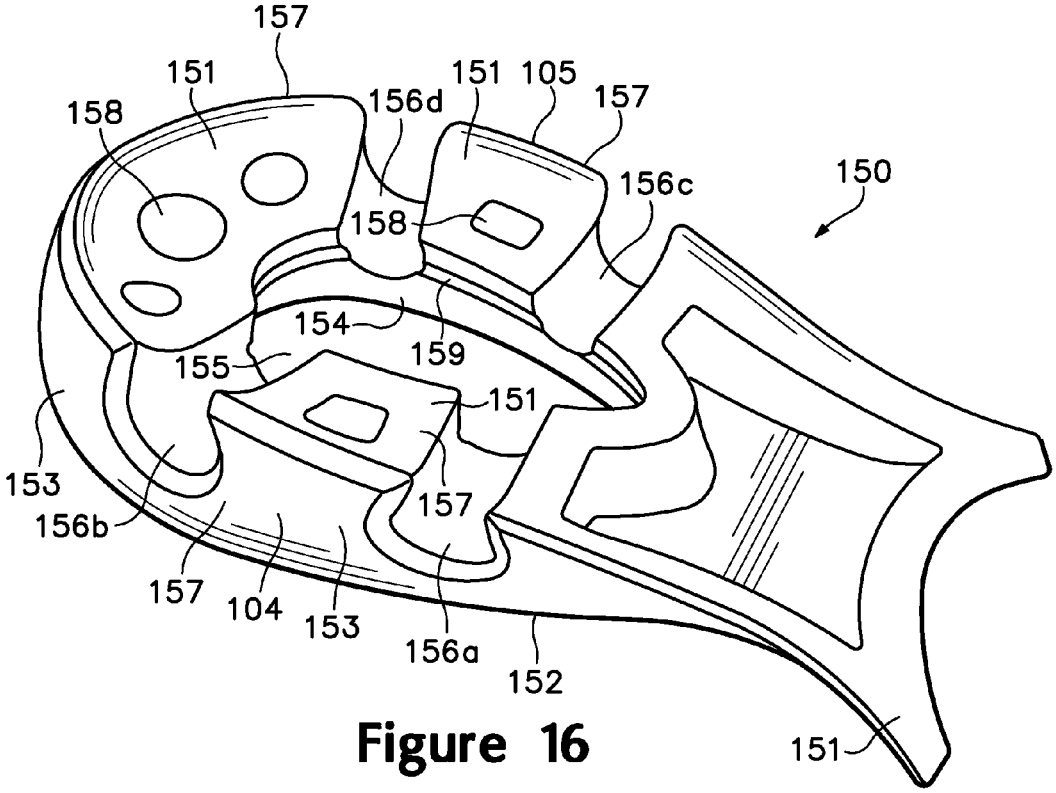
FIG. 16 is a perspective view of the third midsole element.
Figure 21A:
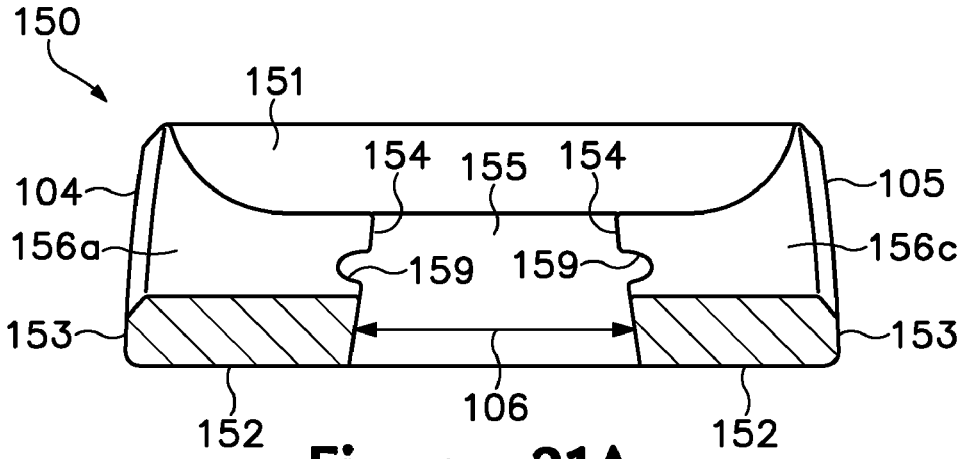
FIG. 21A is a first cross-sectional view of the third midsole element, as defined by section line 21A-21A in FIG. 19.
Figure 21B:
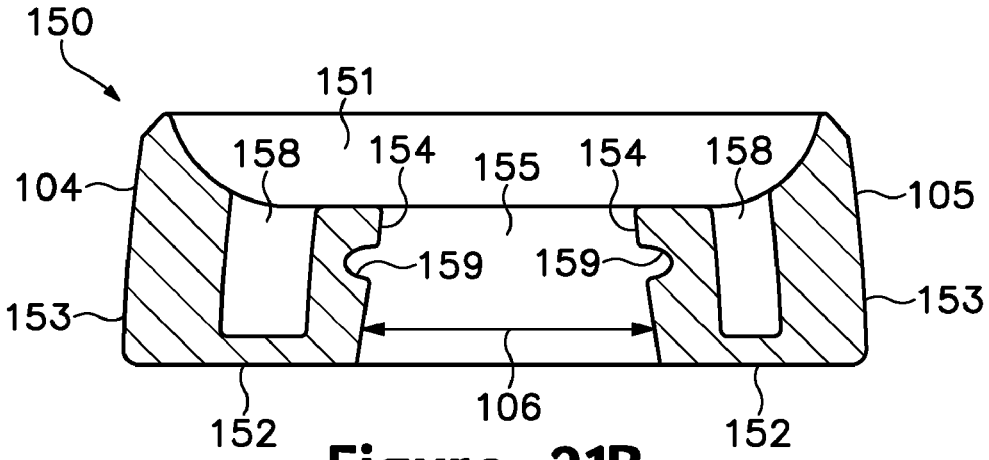
FIG. 21B is a second cross-sectional view of the third midsole element, as defined by section line 21B-21B in FIG. 19.

An indentation 159 circumscribes at least a portion of interior surface 154, as depicted in FIGS. 16, 21A and 21B. Indentation 159 also affects the compressibility of midsole element 150. In effect, indentation 159 increases the compressibility of the portions of midsole element 150 that are adjacent to interior surface 154. That is, indentation 159 increases the compressibility of central areas of midsole element 150 relative to outer areas, which may promote stability in footwear 100. As depicted in the figures, indentation 159 exhibits a semi-circular configuration, but indentation 159 may have a variety of configurations within the scope of the present invention. Although indentation 159 is depicted as extending around substantially all of midsole element 159, indentation 159 may be limited to heel region 103 or may be absent is some embodiments of the invention.

With reference to FIGS. 17 and 18, midsole element 150 tapers downward from the rearward areas to the areas that are positioned in midfoot region 102. The heel areas of some articles of footwear are at a greater elevation than forefoot areas, particularly in athletic footwear. The downward taper facilitates this configuration in footwear 100. In addition, the downward taper forms a wedge-shaped portion of midsole element 150 that extends between plate 121 and outsole 123 in midfoot region 102 and is generally positioned under the arch area of the foot.

Midsole element 150 is depicted as being positioned in heel region 103 and extending into midfoot region 102. In further embodiments of the invention, midsole element 150 may be limited to heel region 103, or midsole element 150 may extend into forefoot region 101. Accordingly, the concepts disclosed herein may be applied to various areas and components of midsole 122.

Based upon the above discussion, midsole element 150 incorporates a variety of features. For example, midsole element 150 may be formed of unitary construction from a single density foam, but may also be formed from foams of different density. In addition, the number of bores 156*a*-156*d* may be the same between lateral side 104 and medial side 105, and some or all of bores 156*a*-156*d* may exhibit substantially constant width dimensions 106 from exterior surface 153 to interior surface 154. Bores 156*a*-156*d* may also impart a trapezoidal shape to the various columns 157. Furthermore, some or all of columns 157 may define cavities 158 that further affect the compressibility of specific areas of midsole element 150.

CONCLUSION

Each of midsole elements 130, 140, and 150 may be formed of unitary construction from a polymer foam material or another material through a substantially conventional molding process. In molding midsole element 130, for example, interior void 135 may be defined in the polymer foam material so as to extend in a substantially vertical direction and from upper surface 131 to lower surface 132. In addition, bores 136*a*-136*e* may be defined in the polymer foam material so as to extend in a substantially horizontal direction and from exterior surface 133 to interior void 135. Bores 136*a*-136*e* may be formed to exhibit substantially constant width, and unequal number of bores 136*a*-136 may be formed in one of lateral side 104 and medial side 105. Similar concepts may be applied to each of midsole elements 140 and 150.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of footwear comprising an upper and a sole structure secured to the upper, the sole structure having a midsole element formed of unitary construction from a polymer foam material, the midsole element defining:

a void extending substantially vertically through a central area of the polymer foam material, the void extending between an upper surface and a lower surface of the midsole element to define an interior surface; and two bores extending substantially horizontally through a lateral side of the polymer foam material, the three bores extending between an exterior surface of the midsole element and the void; and three bores extending substantially horizontally through a medial side of the polymer foam material, the two bores extending between the exterior surface and the void.

2. The article of footwear recited in claim 1, wherein at least one of the three bores and at least one of the two bores have substantially equal width dimensions.

3. The article of footwear recited in claim 1, wherein the bores form columns in the midsole element, and unequal numbers of the columns are formed in the lateral side and the medial side.

4. The article of footwear recited in claim 3, wherein at least one of the columns forms a substantially vertical cavity.

5. The article of footwear recited in claim 1, wherein a ratio of a distance between the lateral side and the medial side to a dimension across the void along the distance between the lateral side and the medial side is 3:1.

6. The article of footwear recited in claim 1, wherein an indentation circumscribes at least a portion of the interior surface.

7. The article of footwear recited in claim 1, wherein at least one of the bores has a substantially constant width dimension.

8. A method of manufacturing a midsole element for an article of footwear, the method comprising steps of:

forming the midsole element of unitary construction from a polymer foam material;

defining a substantially vertical void in the polymer foam material that extends from an upper surface to a lower surface of the midsole element; and defining a plurality of substantially horizontal, constant width bores in the polymer foam material that extend from an exterior surface to the void including forming a medial side of the midsole element to have a greater number of the bores than a lateral side of the midsole element.

9. The method of claim 8, wherein the step of defining a plurality of substantially horizontal, constant width bores further includes forming columns in the midsole element.

10. The method of claim 8, wherein the step of defining a plurality of substantially horizontal, constant width bores further includes defining bores that are substantially surrounded by the polymer foam material of the midsole element.

11. The method of claim 10, wherein the step of defining a plurality of substantially horizontal, constant width bores further includes defining bores that are surrounded on at least three sides by the polymer foam material of the midsole element.

12. A method of manufacturing a midsole element for an article of footwear, the method comprising steps of:

forming the midsole element of unitary construction from a polymer foam material;

defining a substantially vertical void in the polymer foam material that extends from an upper surface to a lower surface of the midsole element;

defining a plurality of substantially horizontal bores in the polymer foam material that extend from an exterior surface to the void; and forming a lateral side and a medial side of the midsole element to have unequal numbers of the bores, wherein the step of forming the lateral side and the medial side includes placing a greater number of the bores on the medial side than the lateral side.

13. The method of claim 12, wherein the step of defining a plurality of substantially horizontal bores further includes forming columns in the midsole element.

14. The method of claim 12, wherein the step of defining a plurality of substantially horizontal bores further includes defining bores that are substantially surrounded by the polymer foam material of the midsole element.

15. The method of claim 14, wherein the step of defining a plurality of substantially horizontal bores further includes defining bores that are surrounded on at least three sides by the polymer foam material of the midsole element.

* * * * *